US007752758B2

(12) United States Patent
Gelardi

(10) Patent No.: US 7,752,758 B2
(45) Date of Patent: Jul. 13, 2010

(54) SYSTEM FOR STORING AND UNPACKING ENCASED ARTICLES

(75) Inventor: John A. Gelardi, Kennebunkport, ME (US)

(73) Assignee: MeadWestvaco Corporation, Richmond, VA (US)

( * ) Notice: Subject to any disclaimer, the term of this patent is extended or adjusted under 35 U.S.C. 154(b) by 439 days.

(21) Appl. No.: 10/560,199

(22) PCT Filed: Jun. 9, 2004

(86) PCT No.: PCT/US2004/018257

§ 371 (c)(1),
(2), (4) Date: Dec. 8, 2005

(87) PCT Pub. No.: WO2004/113200

PCT Pub. Date: Dec. 29, 2004

(65) Prior Publication Data

US 2006/0138017 A1 Jun. 29, 2006

Related U.S. Application Data

(60) Provisional application No. 60/477,485, filed on Jun. 9, 2003.

(51) Int. Cl.
*B26B 29/00* (2006.01)
*B65D 83/04* (2006.01)

(52) U.S. Cl. ..... 30/124; 30/294; 206/528; 206/532; 83/648

(58) Field of Classification Search ..... 83/13, 83/588, 648; 220/267, 284; 206/532, 531, 206/473, 486, 528, 103; 30/124, 2
See application file for complete search history.

(56) References Cited

U.S. PATENT DOCUMENTS

| | | | | | |
|---|---|---|---|---|---|
| 1,452,341 | A | * | 4/1923 | Jacquemin | 24/563 |
| 2,291,294 | A | * | 7/1942 | Holste | 30/294 |
| 3,002,668 | A | * | 10/1961 | Castelli | 225/52 |
| 3,118,228 | A | | 1/1964 | Adams | |
| 3,217,954 | A | * | 11/1965 | Grant et al. | 225/32 |
| 3,380,159 | A | * | 4/1968 | Winston | 30/293 |
| 3,619,902 | A | * | 11/1971 | Fleury | 30/294 |
| 4,159,568 | A | * | 7/1979 | Berner | 30/124 |
| 4,530,154 | A | | 7/1985 | DiCarlo | |
| 4,697,344 | A | * | 10/1987 | Leopoldi | 30/124 |
| 4,711,031 | A | | 12/1987 | Annello | |
| 4,873,767 | A | * | 10/1989 | Lok | 30/278 |
| 4,905,866 | A | * | 3/1990 | Bartell et al. | 221/5 |
| 5,007,171 | A | * | 4/1991 | Horning, Jr. | 30/294 |
| 5,014,431 | A | * | 5/1991 | Jebe et al. | 30/124 |
| 5,127,161 | A | * | 7/1992 | Ikeda | 30/294 |
| 5,285,575 | A | | 2/1994 | Hirano | |
| 5,332,096 | A | | 7/1994 | Battaglia | |

(Continued)

*Primary Examiner*—Ghassem Alie
(74) *Attorney, Agent, or Firm*—Alison R. Scheidler; Tsugihiko Suzuki

(57) ABSTRACT

A system for storing and opening encased articles, such as those wrapped in a protective seal, provides a combined container and seal cutting apparatus. The container is configured to store at least one removable article encased within a protective seal. The seal cutting apparatus includes a receiving channel and a cutting member which extends into the receiving channel. The receiving channel is configured to receive at least a portion of the seal while the cutting member is configured to cooperatively cut the seal portion as it is inserted into and translated along the channel. The cutting apparatus may be permanently or temporarily attached to the container.

14 Claims, 2 Drawing Sheets

U.S. PATENT DOCUMENTS 5,356,010 A * 10/1994 Weinstein ..... 206/532
5,431,283 A * 7/1995 Weinstein et al. ..... 206/531
5,666,731 A 9/1997 Rungren
5,752,319 A 5/1998 Su et al.
5,816,404 A 10/1998 Seidler
5,853,101 A * 12/1998 Weinstein ..... 220/284
5,909,822 A * 6/1999 George et al. ..... 221/25
6,145,722 A * 11/2000 Behrens et al. ..... 225/42
6,557,945 B1 * 5/2003 Eric ..... 30/124
2003/0029880 A1 * 2/2003 Hunts ..... 221/25

* cited by examiner

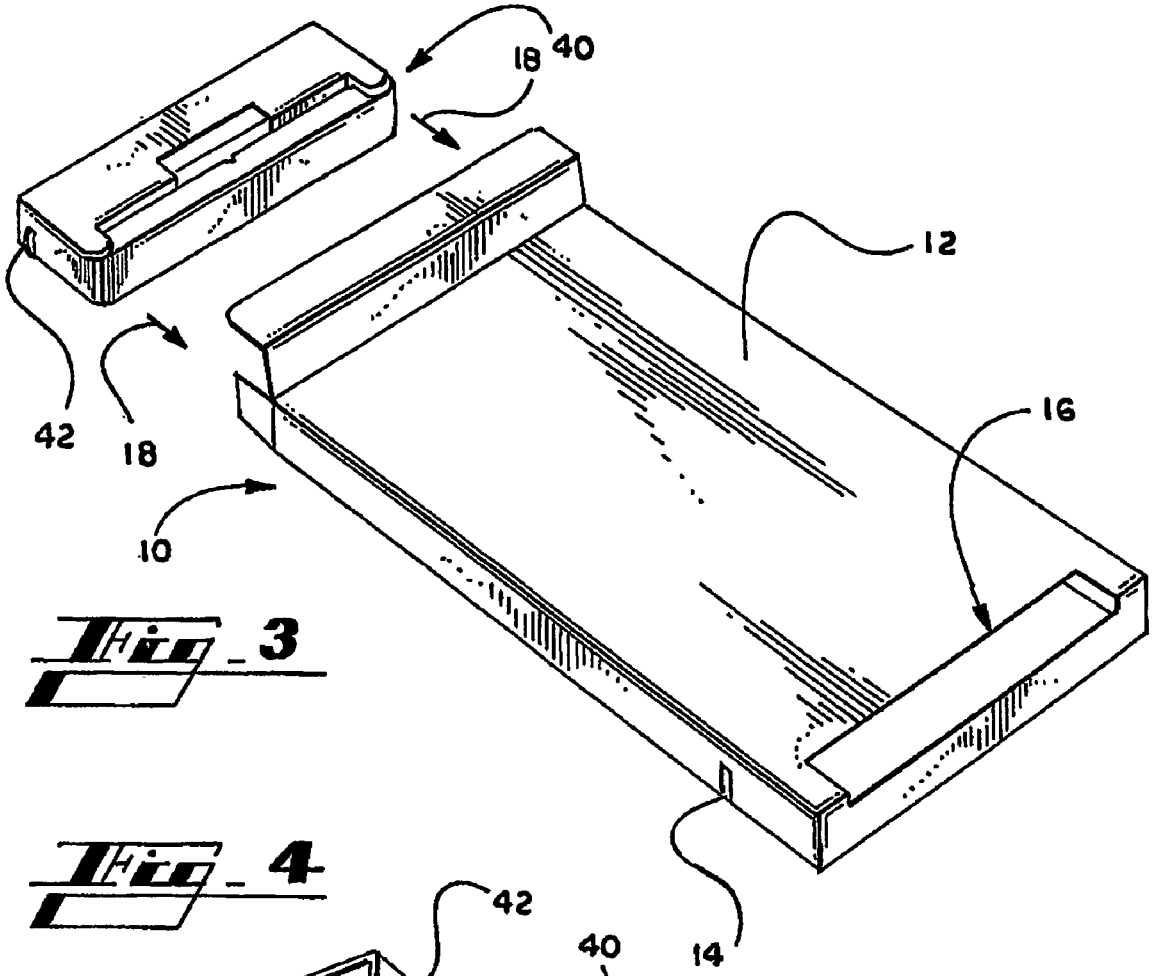
Fig. 3
Fig. 4
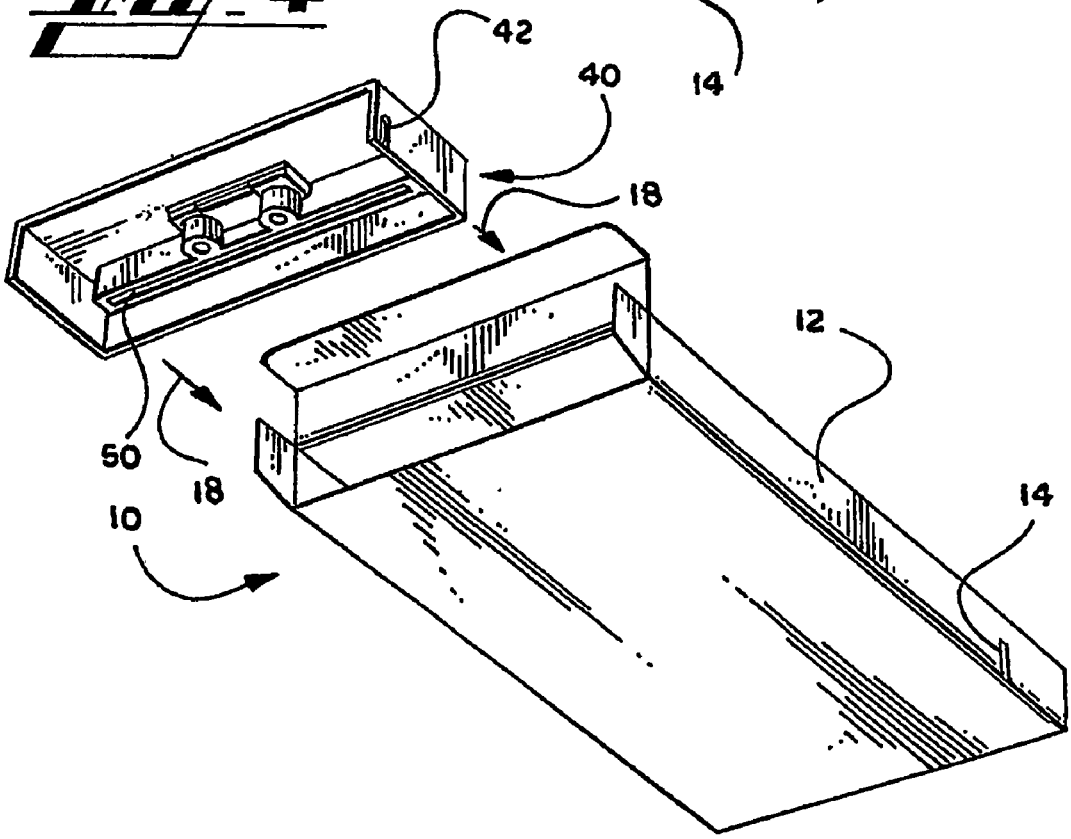

SYSTEM FOR STORING AND UNPACKING ENCASED ARTICLES

CROSS-REFERENCE TO RELATED APPLICATIONS

This application claims the benefit of U.S. Provisional Application Ser. No. 60/477,485 filed Jun. 9, 2003.

BACKGROUND OF THE INVENTION

The invention relates to the packaging of encased articles such as those wrapped in a protective seal, and more specifically to an apparatus for storing and opening a unit blister-pack type package.

A blister-pack is a type of package wherein an item or article to be protected is sealed between a substantially planar substrate and a concave compartment structure resembling a "blister." The blister is typically made of a plastic type material. The substrate may be paper, foil, or plastic, or a laminate of one or more of these materials. The encased item or article is typically removed by pushing the article or item from the blister side of the pack through the planar substrate. In the case of a child-resistant package, both the substrate and blister are made difficult to penetrate.

The blister-pack is useful for packaging individual, or unit, doses of pharmaceutical products. And, when used for this purpose, the blister-pack is particularly suitable for the packaging and distribution of multiple unit doses in a single package. A well known typical multiple blister pack 20 arranged as an array of individual, or unit, dose blister packs is illustrated in FIG. 1. In the pack illustrated, each blister 22 contains a single (or individual, or unit) dose of a medication or similar item. Each unit dose is segregated by lines of demarcation 26. The intersecting lines of demarcation 26 define individual unit dose blister-packs 28. The line of demarcation 26 may be a frangible line such as a perforated line that facilitates separation of a unit 28 from the multiple pack 20.

A problem with a blister-pack is that often it may be difficult to push the item or article, such as pill, through the substrate. This problem exists because often the substrate is made particularly durable to maintain the freshness and efficacy of the encased article. Sometimes the substrate is made to inhibit removal of the encased article or item, as in the use of a child-resistant package. Thus, a need exists for a means for facilitating removal of an encased item or article from a blister-pack or similar protective seal.

It is known to provide a separate package opener that employs a protruding blade to puncture a substrate. However, such blades are typically exposed and create a hazard for users. In addition, such blades are designed to substantially protrude into the package. This configuration creates the possibility of the blade puncturing or otherwise coming into contact with the enclosed item or article. This is especially undesirable in the case of items/articles such as capsules, gel caps or tablets that may be damaged if punctured. Further, it is generally undesirable for a non-sterile foreign object to come into contact with a consumable product.

Although prior attempts to solve the problem of removing an encased article from its protective seal are known, there remains the need for a convenient means to store encased articles together with a means for safely and efficiently cutting the unique protective seal that encases the article.

BRIEF SUMMARY OF THE INVENTION

The present invention provides a system for storing and opening encased articles. By way of example and not limitation, an encased article includes an item that is sealed by any flexible or semi-flexible protective covering, shrink-wrapped, or blister-wrapped. For the purpose of efficiently teaching the present invention, and not as a limitation, the example of a blister-pack will be illustrated and described.

According to one embodiment of the invention, a channel for receiving a flanged edge of a unit dose blister-pack has a cutting edge disposed with respect to the channel so as to engage the flanged edge that is translated along the channel.

In accordance with another embodiment of the invention, a channel for receiving a flanged edge of a unit dose blister-pack is defined between a blister abutment structure and a backstop structure. A cutting edge is disposed with respect to the channel so as to engage the flanged edge translated along the channel. The abutment structure is adapted to abut the blister when the flanged edge is translated along the channel such that the cutting edge does not substantially protrude into the compartment, or cavity, defined by the blister. In accordance with another aspect of this embodiment the cutting edge projects from the backstop. In accordance with yet another aspect of this embodiment, a first height of the abutment structure is offset from a second height of the backstop structure.

Another embodiment of the invention teaches a container for receiving an array of encased articles and an apparatus for opening the seal that encases each of said articles. In accordance with another aspect of this embodiment, the apparatus for opening the seal is disposed within an opening of the container. In another aspect of this embodiment, the container has an opening at one end for receiving the array and the apparatus for opening the seal is disposed at an opening at an opposing end, or an adjacent end, or the same end.

Other advantages and objects of the present invention will be apparent from the following description, the accompanying drawings, and the appended claims.

BRIEF DESCRIPTION OF THE DRAWINGS

FIG. 3 is an exploded isometric view of the embodiment of FIG. 1.

FIG. 4 is the underside view of FIG. 3.

DETAILED DESCRIPTION OF THE INVENTION

Figure 1:
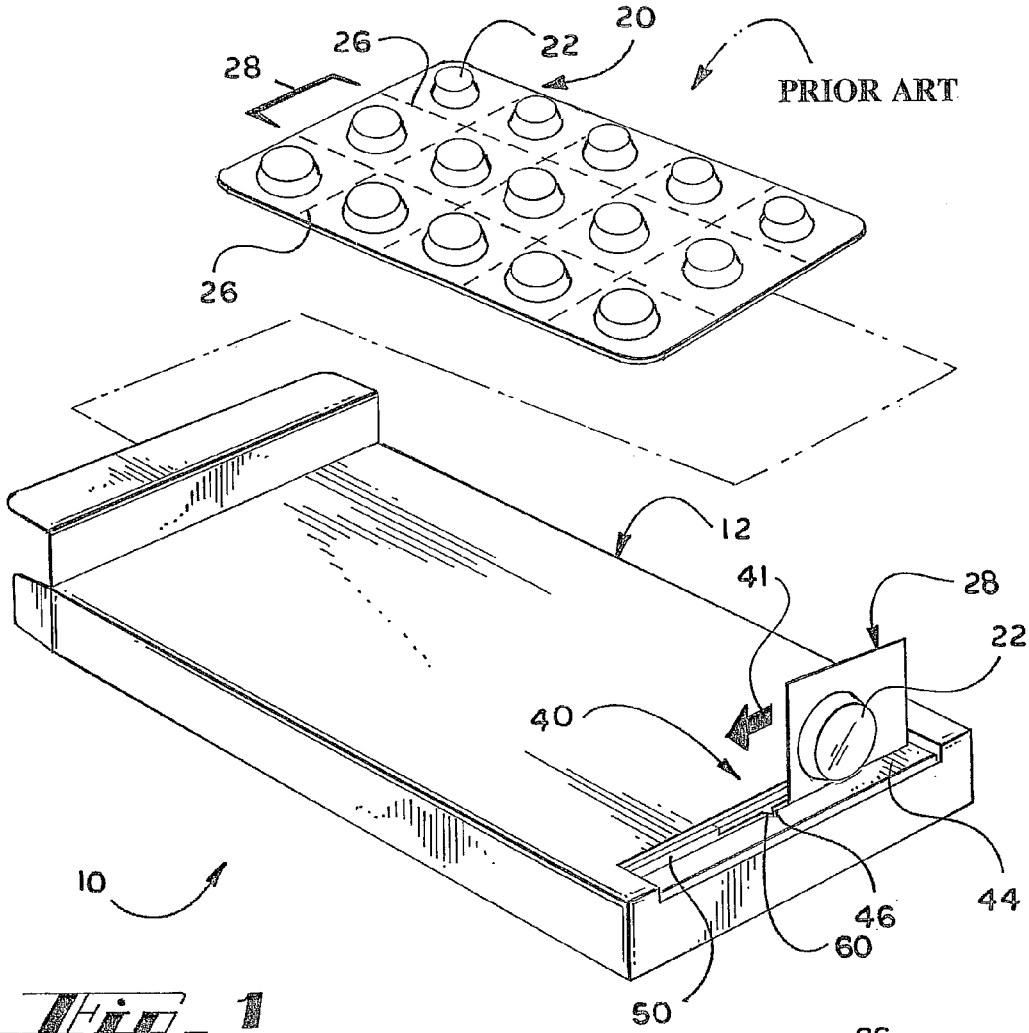
FIG. 1 is an isometric view of the present invention.

Throughout the various figures, the same reference numerals are used to denote the same or like features of the invention.

Referring first to FIG. 1, therein is illustrated an apparatus 40 for opening the seal of an encased article, such as the seal which is a unit blister-pack package 28. Also shown in FIG. 1, but which will be discussed in greater detail later, is a container 12 which together with the apparatus 40 form a system 10 in accordance with an embodiment of the invention. Further illustrated in FIG. 1 is an array 20 of unit dose blister-pack 28 packages.

Figure 2:
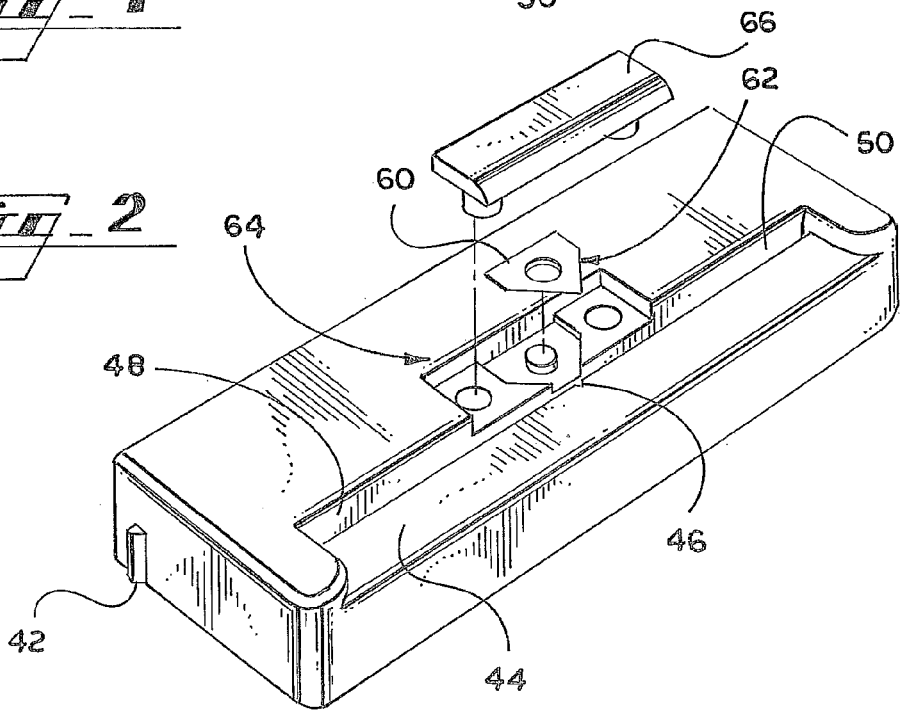
FIG. 2 is an exploded view of the cutting apparatus of FIG. 1.

Referring now simultaneously to FIGS. 1 and 2, the apparatus 40 has a channel 50 with a cutting member 60 having a cutting edge 62 disposed with respect to the channel 50 such that a flanged edge of a unit dose blister-pack 28 is engaged when the flanged edge is translated along the channel 50. One of the flanged edges of the blister-pack 28 is shown disposed within the channel 50 positioned for movement in the direction shown by the direction arrow 41.

The channel 50 is defined by a blister abutment structure 44 and a back stop 48. In FIG. 1, the blister 22 of the unit dose blister-pack 28 is shown abutting the abutment structure 44. The underside of the unit dose blister-pack 28 is shown in contact with the backstop 48 in FIG. 1. In this illustrated embodiment a first height of the abutment structure 44 is offset from a second height of the backstop, thereby forming a stepped or recessed structure for engaging a blister.

Referring again to FIGS. 1 and 2 simultaneously, the cutting member 60 with its cutting edge 62 is shown positioned within and projecting into the channel 50 from the backstop 48.

Referring now particularly to FIG. 2, therein can be seen the manner in which the cutting member 60 can be seated within a seating compartment 64 in the backstop and held in place by a securing member 66. It will be understood that the cutting member 60 may be permanently or temporarily integrated into the apparatus 40 by way of any number of methods known by those skilled in the art.

Referring now to FIGS. 3 and 4 simultaneously, the apparatus 40 is shown separated from the container 12. To form the package 10 of FIG. 1, the apparatus 40 is inserted into the container 12 in the direction illustrated by the arrows 18. In the embodiment illustrated, the apparatus 40 is held in place at the opening 16 of the container by cooperation between detents 42 of the apparatus and slots 14 of the container. As will be understood by those skilled in the art, the apparatus 40 may be attached to the container 12 with mechanical or chemical means including tabs, couples, tapes, adhesives or formed integrally therewith. Alternatively the apparatus 40 may be removably attached to the container 12.

Referring again to FIG. 1, in operation the end-user separates a unit dose blister pack 28 from the array package 20 by tearing along lines of demarcation 26. A flanged edge of an individual, or unit, dose blister-pack 28 is then inserted in the channel 50 and translated in the direction of arrow 41 to cut along the unit dose blister pack 28. The abutment of the blister 22 with the abutment member 44 helps position the pack 28 so that the cutting edge 62 of the cutting member 60 engages the pack 28 below the blister 22 compartment or so close to the perimeter of the blister 22 compartment that the cutting edge 62 does not substantially project into the cavity, or compartment, formed by the blister 22. A relief nick 46 is positioned adjacent the cutting edge 62 and the cutting member 60. The relief nick 46 allows the flanged edge of the pack 28 to deform slightly and depart from the path of the channel sufficiently to prevent bunching at the cutting edge and thereby facilitate initiation of and cutting of the pack 28.

This specification conveys the best mode for carrying out the invention known to the inventor at the time of filing the patent application. Modifications and alternative embodiments may be made in the foregoing without departing from the scope and spirit of the present invention as defined in the appended claims.

I claim:

1. A combination comprising a container, a blister package received in the container and a seal-cutting apparatus, the seal-cutting apparatus comprising:

a receiving channel, the channel being at least partially defined by an edge of a substantially planar first surface and a substantially planar second surface, wherein the first surface is substantially perpendicular to the second surface; and a cutting member located at the second surface and extending toward the first surface;

wherein the seal-cutting apparatus is held in the container at an opening defined in the container such that the opening is entirely closed by the seal-cutting apparatus, wherein the cutting member is disposed inside the container such that the cutting member is accessible from an outside of the container through the opening.

2. The combination of claim 1, wherein the first surface is configured to slideably engage at least one blister of the blister package.

3. The combination of claim 2, wherein the second surface is configured to slideably engage a seal portion of the blister package.

4. The combination of claim 3, wherein the receiving channel is configured to allow insertion of at least one edge of the blister package.

5. The combination of claim 4, wherein, when the blister package is engaged with the first and second surfaces and translated through the receiving channel, at least a portion of the blister package is at least partially severed by the cutting member.

6. The combination of claim 1 wherein the seal-cutting apparatus is held at the opening by cooperation between detents on the seal-cutting apparatus and slots in the container.

7. The combination of claim 1, wherein the seal-cutting apparatus further comprises:

an abutment structure including the first surface; and a backstop structure including the second surface and a substantially planar third surface adjacent to the second surface, the third surface being generally parallel to the first surface and generally perpendicular to the second surface, the first surface being offset from, and recessed with respect to, the third surface.

8. The combination of claim 7, wherein the backstop structure comprises a recessed seating compartment for receiving the cutting member, the recessed seating compartment being defined in the third surface and opening to the second surface so that the cutting member, when received in the recessed seating compartment, is allowed to project from the second surface into the receiving channel.

9. The combination of claim 8, wherein a cutting edge of the cutting member is disposed below the first surface of the abutment structure.

10. The combination of claim 7, wherein the abutment structure has a first height offset from a second height of the backstop structure such that the abutment structure and the backstop structure form a stepped structure.

11. The combination of claim 7, wherein the abutment structure comprises a relief nick positioned along the edge of the first surface, the nick being disposed adjacent to a cutting edge of the cutting member.

12. The combination of claim 1, wherein the blister package comprises a blister, a flanged edge and an underside, and the seal-cutting apparatus further comprises:

an abutment structure having the first surface; and a backstop structure having the second surface, wherein the seal-cutting apparatus is configured to at least partially sever the blister package when the blister package is translated through the receiving channel and at least partially past the cutting member.

13. The combination of claim 12, wherein the cutting member is disposed with respect to the first surface such that when the blister of the blister package is brought into abutment with the first surface, the first surface helps to position a perimeter of the blister to be close to a cutting edge of the cutting member.

14. The combination of claim 1, wherein the opening is elongate, and the receiving channel is disposed in the opening such that the receiving channel extends along the opening.

* * * * *